US011624261B2

(12) United States Patent
da Silva Junior et al.

(10) Patent No.: US 11,624,261 B2
(45) Date of Patent: Apr. 11, 2023

(54) SYSTEM AND METHOD OF INTELLIGENT ELECTRICAL COMPLETION IN RESERVOIRS THAT ALLOW OPEN-HOLE COMPLETION

(71) Applicant: Petróleo Brasileiro S.A.—Petrobras, Rio de Janeiro (BR)

(72) Inventors: Manoel Feliciano da Silva Junior, Rio de Janeiro (BR); Marcello Marques, Niterói (BR); Fabio Rosas Gutterres, Rio de Janeiro (BR); Eduardo Schnitzler, Guarujá (BR); Luciano Ferreira Goncalez, Santos (BR)

(73) Assignee: Petróleo Brasileiro S.A.—Petrobras, Rio de Janeiro (BR)

( * ) Notice: Subject to any disclaimer, the term of this patent is extended or adjusted under 35 U.S.C. 154(b) by 3 days.

(21) Appl. No.: 17/368,910

(22) Filed: Jul. 7, 2021

(65) Prior Publication Data

US 2022/0010676 A1 Jan. 13, 2022

(30) Foreign Application Priority Data

Jul. 7, 2020 (BR) ..... 10 2020 013873 1

(51) Int. Cl.

| | |
|---|---|
| ***E21B 41/00*** | (2006.01) |
| ***E21B 47/13*** | (2012.01) |
| ***E21B 47/06*** | (2012.01) |
| ***E21B 34/04*** | (2006.01) |
| ***E21B 23/06*** | (2006.01) |
| ***E21B 34/06*** | (2006.01) |

(Continued)

(52) U.S. Cl.

CPC ..... *E21B 41/00* (2013.01); *E21B 23/06* (2013.01); *E21B 34/04* (2013.01); *E21B 34/06* (2013.01); *E21B 43/14* (2013.01); *E21B 43/25* (2013.01); *E21B 47/06* (2013.01); *E21B 47/13* (2020.05)

(58) Field of Classification Search

CPC ..... E21B 47/13; E21B 23/06; E21B 34/04; E21B 34/06; E21B 43/25; E21B 47/06; E21B 41/00; E21B 43/12; E21B 43/14

See application file for complete search history.

(56) References Cited

U.S. PATENT DOCUMENTS

| | | | | |
|---|---|---|---|---|
| 6,012,015 A * | 1/2000 | Tubel | ..... | E21B 47/12 702/6 |
| 2014/0083684 A1* | 3/2014 | Tips | ..... | E21B 47/135 166/205 |
| 2018/0030810 A1* | 2/2018 | Saldanha | ..... | E21B 43/12 |

(Continued)

FOREIGN PATENT DOCUMENTS

| | | | |
|---|---|---|---|
| BR | PI0506114 | A | 9/2006 |
| WO | 2016049726 | A1 | 4/2016 |
| WO | 2016175827 | A1 | 11/2016 |

*Primary Examiner* — Brad Harcourt

(74) *Attorney, Agent, or Firm* — Mintz Levin Cohn Ferris Glovsky and Popeo, P.C.

(57) ABSTRACT

The present invention relates to a system and method to be applied to multiple inflow and outflow control zones in an open-hole uncoupled completion. The invention can handle, for example, the complexities and limitations of hydraulic control found in carbonate reservoirs in the Brazilian Pre-Salt, which are characterized by high pressures and flows, large vertical extensions of the reservoir, high scaling potential, and high potential for losses during drilling and completion operations.

20 Claims, 5 Drawing Sheets

(51) Int. Cl.
*E21B 43/25* (2006.01)
*E21B 43/14* (2006.01)

(56) References Cited

U.S. PATENT DOCUMENTS

2018/0156013 A1* 6/2018 Arsalan ..... E21B 33/16
2019/0032481 A1* 1/2019 Lerner ..... G06K 19/06009

* cited by examiner (a)

(b)

SYSTEM AND METHOD OF INTELLIGENT ELECTRICAL COMPLETION IN RESERVOIRS THAT ALLOW OPEN-HOLE COMPLETION

CROSS-REFERENCE TO RELATED APPLICATIONS

This application claims priority to Brazilian Application No. 10 2020 013873 1, filed on Jul. 7, 2020, and entitled "SYSTEM AND METHOD OF INTELLIGENT ELECTRICAL COMPLETION IN RESERVOIRS THAT ALLOW OPEN-HOLE COMPLETION," the disclosure of which is incorporated herein by reference in its entirety.

FIELD OF THE INVENTION

The present invention describes a system and method for applying multiple inflow and outflow control zones in an open hole uncoupled completion.

DESCRIPTION OF THE STATE OF THE ART

The hydraulic control technology currently used limits the number of remotely controlled zones to three: the physical space occupied, the number of penetrations in the Tubing Hanger (component installed at the wellhead, responsible for the mechanical support of the production string), and the operational complexity at the installation and workover (well work) of a string containing multiple packers (downhole plugs) and control lines in a coated and perforated well. The hydraulic actuator control of the valves is dependent on the Wet Christmas Tree (WCT) Subsea Control Module (SCM) and the monitoring system shares electrical power and communication with the WCT's SCM.

Due to the high potential for fluid loss during drilling and completion operations of pre-salt wells, the completion method now requires the use of an uncoupled bottom completion system and the need for expandable open hole packers to ensure selectivity, plus mechanical valves to isolate the well during installation of the lower completion. In this method, only the top completion has remotely controlled valves, limiting the number of zones by the maximum number of concentric annuli. The limit becomes two zones in a well with a reservoir phase of 8½" and three in a well with a reservoir phase of 12¼". Larger diameter alternatives are rendered unfeasible by the cost and complexity of drilling.

The expandable packer is a downhole plug, whose function is to ensure selectivity (isolation) between production or injection areas. The equipment is characterized by having an expandable metal-elastomer sleeve with a sealing area much larger than those found in other types of packers.

Stimulation in wells using both configurations described above is limited by the large extension of the zones and limited accessibility to handling the formation.

The stimulation operation minimizes damage due to well construction operations and ensures a minimum acceptable productivity or injectivity for the well in each zone. The Brazilian Pre-Salt is typically characterized by being treated with acid (acidification).

The high scaling potential, characteristic of pre-salt wells, is also a problem for completion operations, either because of increased flow restrictions or because of the difficulty of intelligent completion equipment projects in ensuring the minimization of scaling adhesion (prevention), or its mechanical removal (mitigation).

Another recurring issue for intelligent completion equipment, especially for valves, is reliability in the life cycle of a well.

The basic principles of this invention are: flexibility in the use of a downhole fault-tolerant automation network which, through a busbar architecture, allows a number of nodes limited only by the available electrical power; the use of a proximity coupler, which allows the use of an uncoupled bottom completion system; the use of an electric actuator based on an axial magnetic flux motor; the use of cage-(annular/string) or ball- (string/string) type flow control valves.

Document PI0506114A discloses a procedure for completing drilled wells. In general, it seeks to improve the level of efficient control over fluid flow coming from or directed to one or more formations. Unlike this invention, it does not refer to the type of valve, or to the axial magnetic flux motor of the actuators, in addition to the system being different.

Document WO2016049726A1 reveals an intelligent completion system in one or several production zones, including mechanisms and devices capable of promoting safer, more efficient, and more economically viable well exploration. Unlike the invention, it does not refer to the use of a proximity coupler for uncoupled bottom completion, or an electric actuator based on an axial magnetic flux motor. Furthermore, the method proposed by the invention is different.

Document WO2016175827A1 consists of a completion assembly used in an open hole section for exploration, and specifically an intelligent completion assembly based on remotely fed casing. Unlike the present invention, it does not mention a downhole fault-tolerant automation network or a proximity coupler, in addition to the system being different.

The documents found in the state of the art do not have the unique characteristics that will be presented in detail below.

BRIEF DESCRIPTION OF THE INVENTION

The present invention relates to a system and method for applying multiple inflow and outflow control zones in an open hole uncoupled completion.

The system and method, which are the purposes of this invention, can handle, for example, the complexity and limitations of hydraulic control found in carbonate reservoirs in the Brazilian Pre-Salt, characterized by high pressures and flows, large vertical extensions of the reservoir, high scaling potential, and high potential for losses during drilling and completion operations.

BRIEF DESCRIPTION OF THE DRAWINGS

The present invention will be described in greater detail below, with reference to the attached figures which, in a schematic and non-limiting way, represent examples of its realization. The figures are.

DETAILED DESCRIPTION OF THE INVENTION

Figure 1:
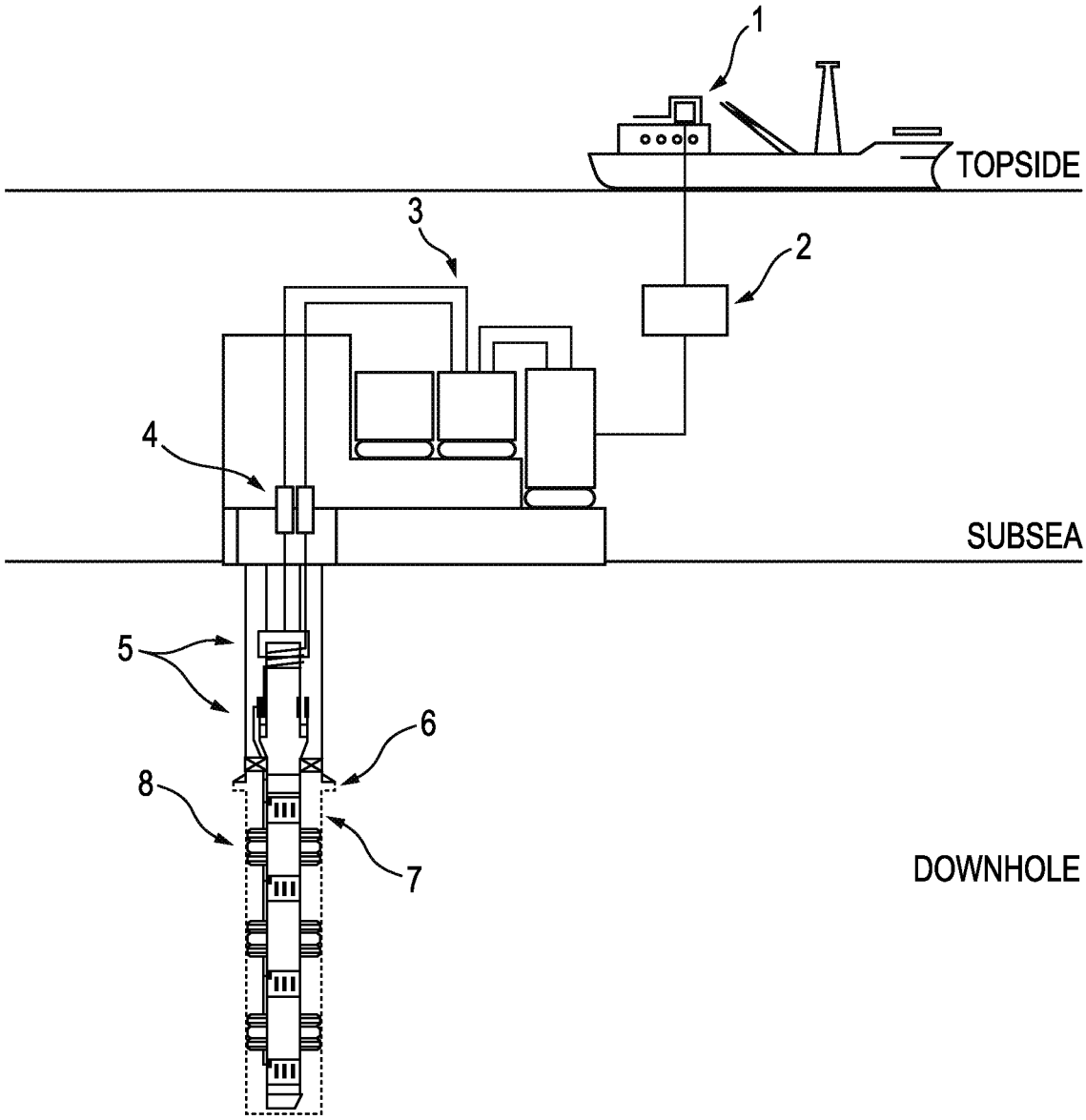
FIG. 1, which shows Electrical Intelligent Completion with open hole decoupled bottom completion. The numbered items are: (1) SCS (Supervision and Control System), (2) EHDU (Electro-Hydraulic Distribution Unit), (3) COMP-SCM (Completion Subsea Control Module), (4) Wet Electrical Connector between the TH (Tubing Hanger) and WCT (Wet Christmas Tree), (5) PC (Proximity Coupler) and EEJ (Electrical Expansion Joint), (6) TCS (Telemetry and Control System), (7) FCS (Flow Control System) and WMS (Well Monitoring System), (8) expandable open hole packer.

Electric Intelligent Completion with lower open hole uncoupled completion, the purpose of this invention is characterized by the subsystems shown in FIG. 1:

- Item (1) comprises the SCS (Supervision and Control System) module installed in the production unit;
- Item (2) comprises an EHDU (Electro-Hydraulic Distribution Unit) formed by a shared-control umbilical and distribution unit;
- Item (3) comprises a COMP-SCM (Completion Subsea Control Module);
- Item (4) comprises one or two electrical connectors wetted on the WCT;
- Item (5) comprises a PC (proximity coupler), equipment responsible for disconnecting and reconnecting the production or injection string, keeping the electrical control lines functional, and an EEJ (electrical expansion joint), which is equipment that allows balancing (space out) of the production or injection string for laying and locking the column suspender (Tubing Hanger) with passage of electrical control lines. Alternatively, in the event of contingency, the WDT+EHEJ assembly should be used. The WDT (Wet Disconnection Tool) and the EHEJ (Electro-Hydraulic Expansion Joint) respectively perform the same function as the previous equipment, but now they include the hydraulic control lines in addition to the electrical lines;
- Item (6) comprises a TCS (Telemetry and Control System);
- Item (7) comprises a FCS (Flow Control System) and an WMS (Well Monitoring System) containing an electric actuator based on an axial magnetic flow motor and 4½", 5½" or ball sliding sleeve valve with sensors for position, vibration, pressure and temperature;
- Item (8) comprises an expandable open hole packer with passages.

The subsystems that comprise the Intelligent Electric Completion shown in FIG. 1 of this invention solve or minimize the challenges of completion in the Brazilian Pre-Salt scenario, characterized by high pressures and flows, large vertical extensions of reservoir, high potential for scaling, and high potential for severe fluid loss.

Figure 2:
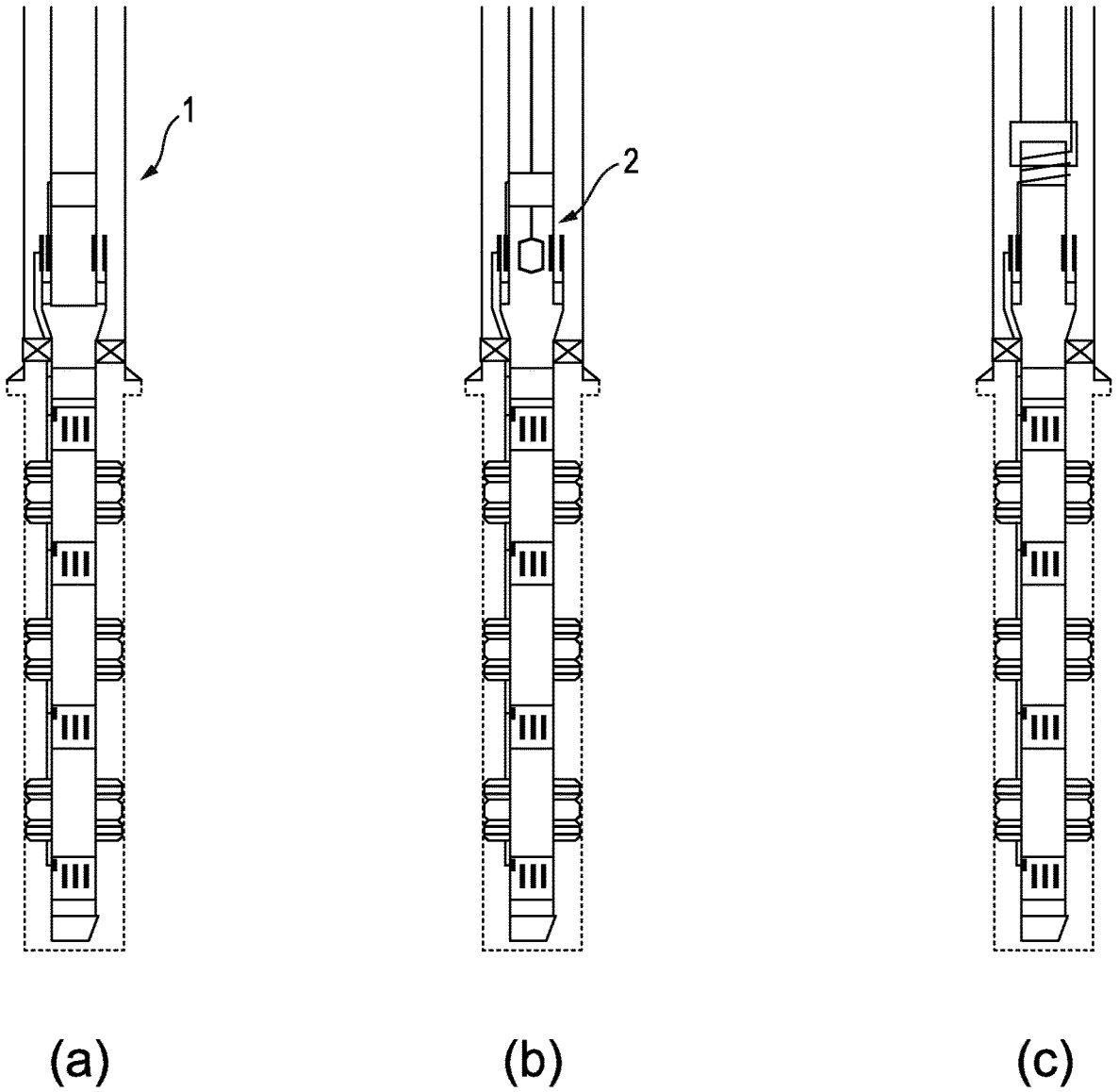
FIG. 2, which shows the installation of Electrical intelligent Completion in two runs. Items indicated are: (a) installation of lower completion, (1) Working Column with Running Tool and workover TCS, (b) installation of lower completion (2) Working Column with Running Tool in through-tubing operation for confirmation of operation of lower completion (workover failing TCS), (c) installation of upper completion.

The installation of the Intelligent Electrical Completion is divided into two parts, as shown in FIG. 2. In the first part, the lower completion (tail) is installed, maintaining the monitoring and movement of the valves without cables through the TCS (Telemetry and Control System) of workover. In the second part, the production column or injection column is installed.

The installation sequence done in two runs is presented below.

- Down Working Column with Running Tool, TCS (Telemetry and Control System) of the workover (TCS+PC (Proximity Coupler)+WTM (Wireless Telemetry Module)+Battery Module (BM), or Proximity Telemetry Module (PTM) (through the tubing operation) with open valves;
- Optionally perform chelator or weak acid positioning in the open well;
- Close ICVs—Interval Control Valve (Intelligent Completion Valves) acting via workover TCS (Telemetry and Control System) or PTM (Proximity Telemetry Module);
- Seat packer feedthrough and expandable open hole packers (against running tool and valves);
- Perform packer feedthrough integrity test;
- Optionally, perform a tightness test of the intermediate packers, opening ICVs and injecting them into the formations. When injecting in reservoirs it is possible, using techniques such as fall-off (transient pressure), to assess the injectivity of the zone and, indirectly, if there is loss of selectivity (isolation) due to packers, which would indicate the failure in the settlement. In practice, the differential fall-off is observed in each zone (via pressure sensors) and, with this, it is possible to verify the settlement of the packers.
- Close ICV (Intelligent Completion Valve) and test for leaks. The test indicates the end of installation of the lower completion;
- Release Running Tool with workover TCS;
- Remove Working Column;
- Lower upper completion with PC (Proximity Coupler) and EEJ (Electrical Expansion Joint);
- Seat and lock PC;
- Release EEJ;
- Seat and lock TH (Tubing Hanger) and perform TH and production column/injection column tests;
- Open lower ICV;
- Perform lower zone stimulation;
- Close lower ICV and open lower intermediate ICV;
- Perform stimulation of the lower intermediate zone;
- Close lower intermediate ICV and open upper intermediate ICV;
- Perform stimulation of upper intermediate zone;

Close upper intermediate ICV and open upper ICV;
Perform upper zone stimulation;
Close and test ICVs and DHSV (Downhole Safety Valve);
Abandon well to SESV (Subsea Equipment Support Vessel) and install WCT (Wet Christmas Tree).

The example sequence presented is for a well with 4 (four) producing or injecting zones. This means 4 (four) intervals that will be stimulated. Thus, the process is repeated for each zone: upper, upper intermediate, lower intermediate, and lower. Only one zone receives treatment at a time; therefore, only one valve is open, and the others remain closed.

The Intelligent Electrical Completion, the purpose of this invention, is divided into SCS (Supervision and Control System), characterized by a fault-tolerant network automated distributed system, and TCS (Telemetry and Control System) subsystems.

Figure 3:
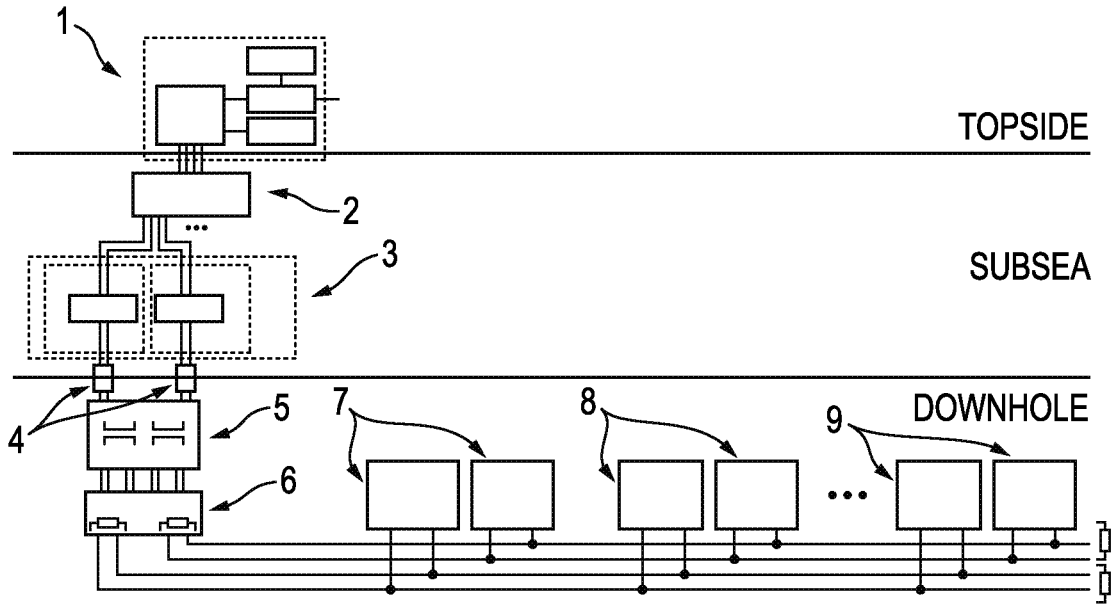
FIG. 3, which shows (a) block diagram of intelligent completion in a fault-tolerant automation network (with electrical busbar redundancy). The items indicated in it are: (1) SCS (Supervision and Control System), (2) EHDU (Electro-Hydraulic Distribution Unit), (3) COMP-SCM (Completion Subsea Control Module), (4) Wet Electrical Connector between TH (Tubing Hanger) and WCT (Wet Christmas Tree), (5) PC (Proximity Coupler), (6) TCS (Telemetry and Control System), (7) and (8) FCS (Flow Control System), and (9) WMS (Well Monitoring System) of zones 1, 2 and N. (b) Block diagram of intelligent network completion (no electrical busbar redundancy), (1) SCS (Supervision and Control System), (2) EHDU (Electro-Hydraulic Distribution Unit), (3) COMP-SCM (Completion Subsea Control Module), (4) Wet Electrical Connector between the TH (Tubing Hanger) and WCT (Wet Christmas Tree), (5) PC (Proximity Coupler), (6) TCS (Telemetry and Control System), (7) and (8) FCS (Flow Control System) and (9) WMS (Well Monitoring System) of zones 1, 2 and N.
Figure 3:
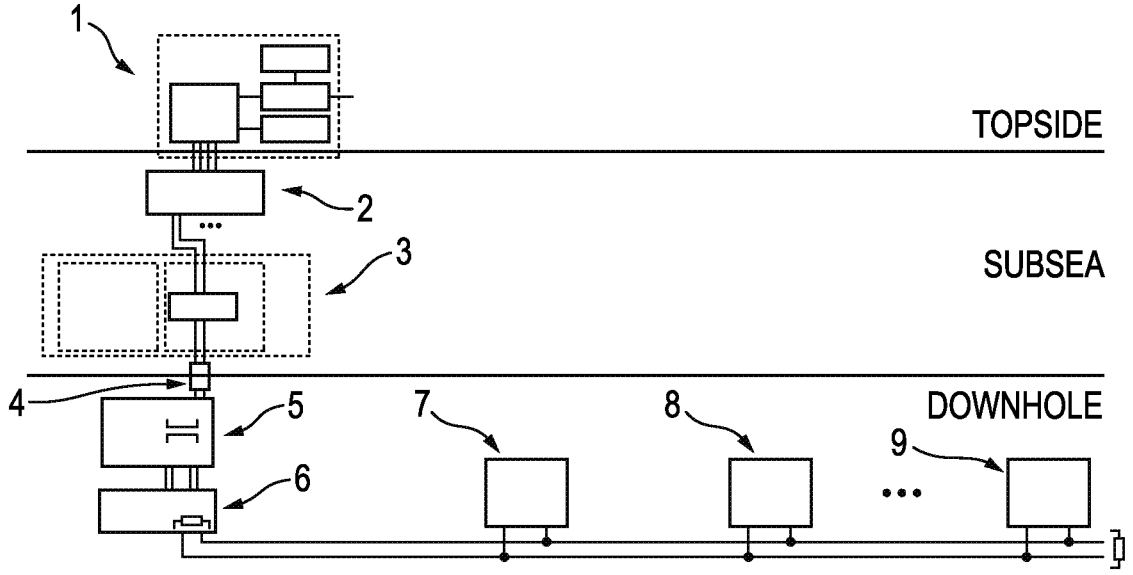

The SCS consists of a set of power-over-communication modems, point-multipoint type, from the surface to the completion subsea control module (COMP-SCM), which they make the electricity supply and communication of the network nodes transparent to the physical subsea layout, as shown in FIG. 3, for an example of a shared umbilical. The subsea control module serves as an intelligent repeater, allowing control and system data access in the event of an umbilical failure.

In the well, the TCS serves as a gateway, an intelligent passage between different environments, allowing not only control and data access, but the conversion of the network into an industry-standard network, enabling the integration of network nodes regardless of the manufacturer.

The workover TCS is used in the installation, formed by a version of the TCS equipped with a wireless telemetry module, battery module, and superior PC. The workover telemetry and control system (TCS) is used only during installation of completion, or during a workover to allow intelligent completion to function in conjunction with the Working Column. FIG. 3 shows the automation network that is the heart of the SCS, with redundancy (a) and without redundancy (b).

The PC (Proximity Coupler) enables uncoupled bottom completion, allowing electricity supply and communication at installation and re-entry of the intelligent electrical completion.

The WMS (Well Monitoring System) is comprised of punctual or almost-distributed pressure and temperature sensors (jargon used in the industry to characterize a set of sensors in a series, typically in a number greater than 10). As they are nodes on the automation network, connectivity and interoperability are guaranteed.

Figure 4:
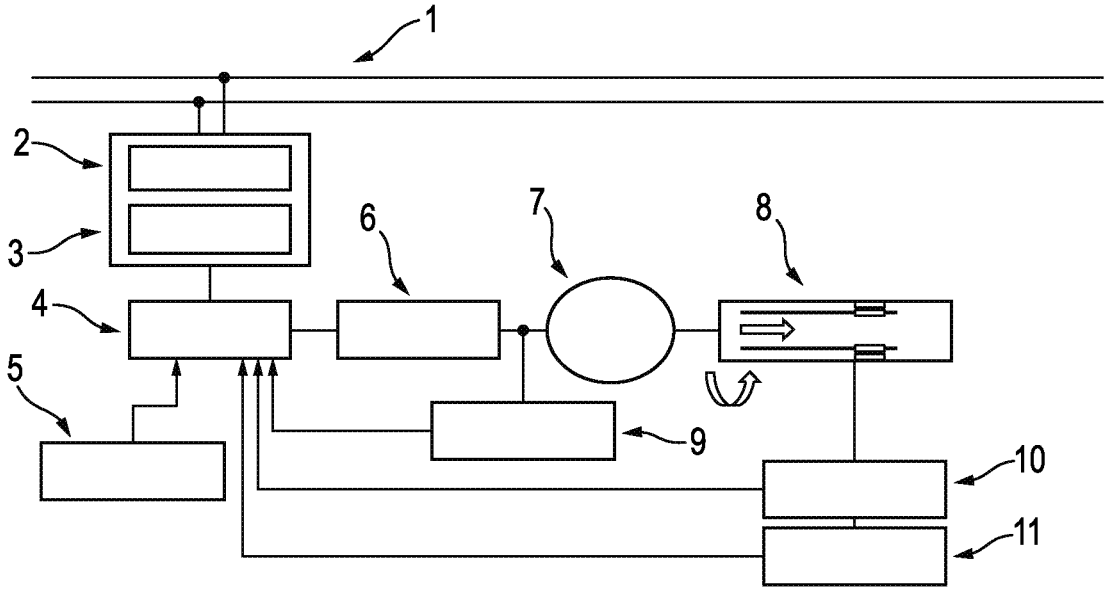
FIG. 4, which shows a (1) Fault-Tolerant Automation Network Barring, (2) Transceiver, (3) Network Controller, (4) Valve Actuator Controller, (5) Internal Condition Sensors, (6) Inverter, (7) Spiral Motor (AFPM), (8) Sliding Sleeve Valve and Ball 4½" and 5½", (9) Current Sensor, (10) Linear and Angular Position Sensor, (11) Vibration Sensor.

The FCS (Flow Control System) comprises a valve actuated by an AFPM (Axial Flux Permanent Magnet) spiral motor, as shown in FIG. 4. The motor allows the valve position to be controlled through helical movement, whether for a cage-type valve, or for a ball-type valve. The main differential of the valve lies in the simplification of the mechanical design by using the APFM spiral motor (both for cage-type and ball-type valves) and by minimizing the effect of the passage from static to dynamic friction even in the presence of debris (solid waste of any kind, of small size) and scaling.

Figure 5:
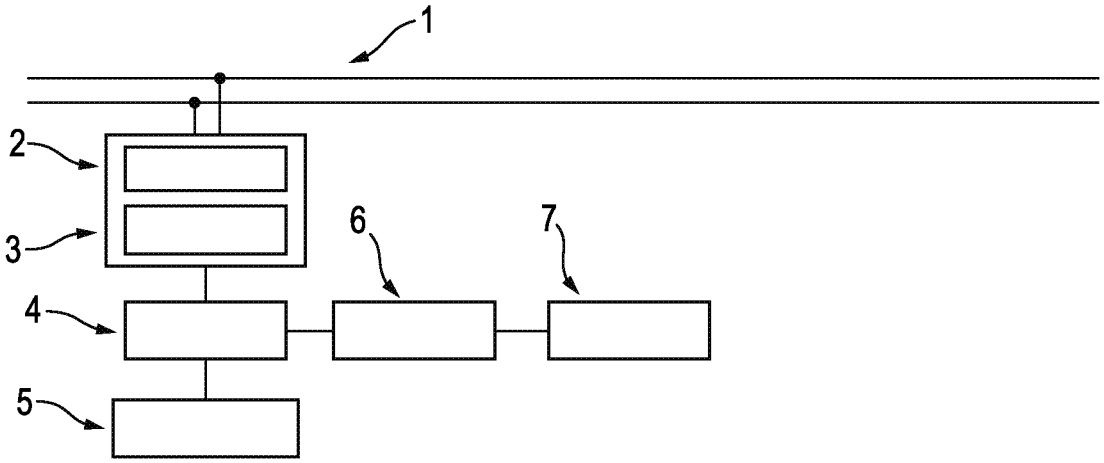
FIG. 5, which shows a (1) Fault-Tolerant Automation Network Barring, (2) Transceiver, (3) Network Controller, (4) Sensor Controller, (5) Internal Condition Sensors, (6) Conditioner, (7) Transducer.

The fault-tolerant automation network barring is shown in FIG. 4 and FIG. 5.

The invention claimed is:

1. An electrical intelligent completion system, comprising:
a supervision and control system (SCS);
a telemetry and control system (TCS);
a proximity coupler (PC);
a flow control system (FCS); and
a well monitoring system (WMS);
wherein the SCS is formed by a set of power-over-communication modems, of the point-multipoint type, from the surface to a completion subsea control module (COMP-SCM).

2. The system of claim 1, wherein the SCS is a distributed control system on a fault-tolerant automation network.

3. The system of claim 1, wherein the COMP-SCM serves as an intelligent repeater that allows control and data access of the system in an event of failure in an umbilical or in the Electro-Hydraulic Distribution Unit (EHDU).

4. The system of claim 1, wherein the TCS serves as an intelligent gateway that allows control and data access and conversion of a network into an industry standard network.

5. The system of claim 1, wherein the PC allows an uncoupled lower completion.

6. The system of claim 1, wherein the PC allows electrical supply and communication during installation and re-entry of an intelligent electrical completion.

7. The system of claim 1, wherein the WMS has spot or almost-distributed pressure and temperature sensors.

8. A method of intelligent completion in with the system defined in claim 1, the method comprising:
lowering a working column with a running tool, workover TCS (TCS+upper proximity coupler (PC)+wireless telemetry module (WTM)+battery module (BM)) and lower completion with a lower PC with open valves;
closing intelligent completion valves (ICVs) upon actuation via the workover TCS or a proximity telemetry module (PTM);
seating packer feedthrough and expandable open hole packers against the running tool and valves;
performing a packer feedthrough integrity test;
performing an integrity test on expandable packers;
closing ICVs and testing for tightness;
releasing the running tool with the workover TCS;
removing the working column;
lowering superior completion with an upper PC and an electrical expansion joint (EEJ);
seating and locking the upper PC;
releasing the EEJ;
seating and locking a tubing hanger (TH) and performing TH and production column/injection column tests;
opening a lower ICV of the ICVs;
performing a lower zone stimulation;
closing the lower ICV of the ICVs and opening a lower intermediate ICV of the ICVs;
performing stimulation of a lower intermediate zone;
closing the lower intermediate ICV and opening an upper intermediate ICV of the ICVs;
performing stimulation of an upper intermediate zone;
closing the upper intermediate ICV and opening an upper ICV of the ICVs;
performing an upper zone stimulation;
closing and testing the ICVs and a downhole safety valve (DHSV); and
abandoning well to a subsea equipment support vessel (SESV) and installing a wet christmas tree (WCT).

9. The method of claim 8, further comprising positioning a chelator or weak acid in an open hole.

10. The method of claim 8, wherein the step of performing the integrity test comprises monitoring, via intelligent completion pressure and temperature sensors, a differential fall-off.

11. The method of claim 8, wherein the step of preforming the integrity test further comprises opening ICVs and injecting into reservoirs.

12. A method of intelligent completion in with the system defined in claim 1, the method comprising:

lowering a production column/injection column with open intelligent completion valves (ICVs);

seating and locking tubing hanger (TH) and performing TH and production column/injection column tests;

closing the ICVs;

seating a feedthrough packer and expandable open hole packers;

performing an integrity test on the expandable packers;

opening a lower ICV of the ICVs;

performing a lower zone stimulation;

closing the lower ICV of the ICVs and opening a lower intermediate ICV of the ICVs;

performing stimulation of the lower intermediate zone;

closing the lower intermediate ICV and opening an upper intermediate ICV of the ICVs;

performing stimulation of an upper intermediate zone;

closing the upper intermediate ICV and opening an upper ICV of the ICVs;

performing an upper zone stimulation;

closing and testing the ICVs and a downhole safety valve (DHSV); and abandoning well to a subsea equipment support vessel (SESV) and installing a wet christmas tree (WCT).

13. The method of claim 12, further comprising positioning a chelator or weak acid in an open hole.

14. The method of claim 12, wherein the step of performing the integrity test comprises monitoring, via intelligent completion pressure and temperature sensors, a differential fall-off.

15. The method of claim 12, wherein the step of preforming the integrity test further comprises opening ICVs and injecting into reservoirs.

16. An electrical intelligent completion system, comprising:

a supervision and control system (SCS);

a telemetry and control system (TCS);

a proximity coupler (PC);

a flow control system (FCS); and a well monitoring system (WMS);

wherein the SCS provides electricity supply and communication of nodes of a transparent network to a subsea physical layout.

17. An electrical intelligent completion system, comprising:

a supervision and control system (SCS);

a telemetry and control system (TCS);

a proximity coupler (PC);

a flow control system (FCS); and a well monitoring system (WMS);

wherein the TCS comprises a workover TCS equipped with a wireless telemetry module, battery module and top module of the PC.

18. An electrical intelligent completion system, comprising:

a supervision and control system (SCS);

a telemetry and control system (TCS);

a proximity coupler (PC);

a flow control system (FCS); and a well monitoring system (WMS);

wherein the FCS is a valve actuated by an Axial Flux Permanent Magnet (AFPM) spiral motor.

19. The system of claim 18, wherein the AFPM spiral motor allows control of a valve position through helical movement of a cage-type valve or a ball-type valve.

20. The system of claim 18, wherein the WMS has spot or almost-distributed pressure and temperature sensors.

* * * * *